US006776231B2

(12) United States Patent
Allen

(10) Patent No.: US 6,776,231 B2
(45) Date of Patent: Aug. 17, 2004

(54) CASING SCRAPER

(75) Inventor: Anthony Allen, Scunthorpe (GB)

(73) Assignee: Ruff Pup Limited (GB)

( * ) Notice: Subject to any disclaimer, the term of this patent is extended or adjusted under 35 U.S.C. 154(b) by 317 days.

(21) Appl. No.: 10/067,037

(22) Filed: Feb. 4, 2002

(65) Prior Publication Data

US 2002/0104649 A1 Aug. 8, 2002

(30) Foreign Application Priority Data

Feb. 6, 2001 (GB) ..... 0102931
Mar. 21, 2001 (GB) ..... 0107011

(51) Int. Cl.[7] ..... E21B 37/00

(52) U.S. Cl. ..... 166/173; 166/312; 15/104.2; 134/166 C; 134/168 C

(58) Field of Search ..... 15/104.05, 104.16, 15/104.2; 134/166 C, 167 C, 168 C; 166/170, 173, 174, 176, 312

(56) References Cited

U.S. PATENT DOCUMENTS 2,503,719 A * 4/1950 Garrison ..... 166/173
2,913,053 A * 11/1959 Westbrook ..... 166/152
4,484,625 A * 11/1984 Barbee, Jr. ..... 166/185
5,086,842 A * 2/1992 Cholet ..... 166/312
6,250,387 B1 6/2001 Carmichael et al. ..... 166/311

FOREIGN PATENT DOCUMENTS

WO WO 00/12864 3/2000

* cited by examiner

*Primary Examiner*—Mark Spisich
(74) *Attorney, Agent, or Firm*—Fay, Sharpe, Fagan, Minnich & McKee, LLP

(57) ABSTRACT

A casing scraper comprises a generally cylindrical body (1) adapted for connection at one end to a drill string, having a plurality of scraping or scouring elements (2) disposed around the outer surface thereof. A pipe (6) extends through the cylindrical body (1). One end of the pipe (6) is adapted for connection to a source of cleaning fluid and the other end is connected to a tail pipe (7). The tail pipe (7) has at least one opening (8) in it through which cleaning fluid may be circulated into the well casing. The casing scraper further comprises filtration structure (4) located above the openings (8) in the tail pipe (7) and remotely operable structure (9, 10) for selectively directing the flow of cleaning fluid from passing outside the filtration structure (4) to passing through the filtration structure (4).

20 Claims, 4 Drawing Sheets

CASING SCRAPER

The present invention relates to a casing scraper for cleaning the inside of a tubular member and more specifically for cleaning the interior surfaces of pipelines or oil, gas, or water well casings, tubes or pipes.

It is usual to ensure and maintain the physical integrity of a well bore hole by lining it with a casing, typically steel pipe, as it is drilled. This casing wall is cemented in place during completion of the drilling operation. This cementing operation leaves cement residue on the casing wall which must be removed before the well is put into production. Furthermore cleaning of the casing wall is necessary at intervals during well production to remove accumulated debris and residues, such as oil, paraffin and scale. Studies have demonstrated that debris and residues on the internal walls of the well casing have a negative impact on well productivity.

The standard tools used for cleaning casing walls are referred to as casing scrapers and are well known in the art. Typically a casing scraper comprises a cylindrical body having a plurality of scraper blades or wire bristles disposed at intervals around its outer surface, and a mandrel which facilitates connection to a drill string. In use, the casing scraper is mechanically driven through the well casing on the drill string, causing the scraper blades or bristles to scrape the inner surface of the well casing.

The casing scraper may be mounted towards the end of the drill string or at a point along its length depending on the region of the well casing which it is required to be used on.

It is known to improve the cleaning action of casing scrapers by circulating cleaning fluid down the drill string to the casing scraper. The cleaning fluid may exit the drill string at a point below the casing scraper to flow back around the exterior of the cleaning scraper, carrying with it debris and residues scraped from the wall of the well casing as it does so. Alternatively, the cleaning fluid may be directed under pressure through radially extending nozzles in the wall of the casing scraper to scour the wall of the well casing. Fluid circulation around the casing scraper causes debris and residues scraped from the casing walls to be carried to the surface of the well bore for removal.

Whilst the effectiveness of conventional casing scrapers varies from one design to another they all have in common that it is not possible to determine whether debris and residues arriving at the surface of the well bore in the cleaning fluid has been scoured from the particular region of the well casing which is actually subject to cleaning action. In this regard, it will be understood that the cleaning fluid circulating back to the surface of the well bore may pick up material which has been dislodged from the walls of the well casing above the casing scraper itself, as well as below it. This is unsatisfactory in that the well operator has no way of knowing whether the cleaning device is operating in an effective manner.

It is an object of the present invention to provide a casing scraper for cleaning the interior wall of a well casing which allows debris scoured from the wall of a well casing in the immediate vicinity thereof to be collected at will for subsequent inspection at the surface of the well bore.

According to the present invention there is provided a casing scraper for cleaning the interior wall of a well casing, comprising a generally cylindrical body defining an uppermost end adapted for connection to a drill string and having a plurality of scraping or scouring elements disposed around the outer surface thereof for contacting the interior wall of the well casing and a bore extending through the cylindrical body, one end of which bore is adapted for connection to a source of cleaning fluid and the other end of which bore is connected to a tail pipe extending below the lowermost end of the cylindrical body, which tail pipe has at least one opening in it through which cleaning fluid may be circulated into the well casing, wherein the casing scraper further comprises a filter located above the openings in the tail pipe and remotely operable means for selectively directing the flow of cleaning fluid from passing outside the filtration means to passing through the filtration means.

In a preferred embodiment of the present invention the filtration means is housed within the cylindrical body and forms an annulus around the bore extending therethrough. However, it may be housed separately from the cylindrical body, for example, on the tail pipe beneath the cylindrical body.

Conveniently, the means for selectively directing cleaning fluid to pass through the filtration means comprises a radially expandable element, such as a rubber plug, which is engageable with the casing wall to prevent fluid flow around the periphery thereof, which rubber plug has flow apertures therein through which cleaning fluid can pass into the filtration means. In normal use fluid takes the path of least resistance around the periphery of the rubber and little or no fluid passes through the filtration means. However, when the rubber plug is operated to block the fluid flow path around its periphery the fluid is forced to pass through the flow apertures and into the filtration means.

Conveniently, the rubber plug is annular and is mounted on the said tail pipe, above the apertures therein. Radial expansion of the rubber plug is achieved by compressing it between two plates which are operatively moveable relative to one another to reduce the distance therebetween. The relative movement may be achieved in a variety of ways. Preferably, one of the said plates is mounted on the lower end of the cylindrical body and the other is mounted on the said tail pipe, and the tail pipe is able to move longitudinally within the bore extending through the cylindrical body to shorten the distance between the plates.

Preferably, the rubber plug is rotatable relative to the tail pipe. This may be achieved by providing bearings between the rubber plug and the tail pipe. This allows the drill string and the tail pipe to be rotated in the well casing even when the rubber plug is radially compressed to engage with the interior wall of the well casing. Rotating the drill string and the tail pipe causes turbulence within the fluid and greatly improves the cleaning action thereof.

Rotary movement of the drill string is particularly beneficial in wells that are not vertical. Here, the drill string lays against the walls. If chemicals are pumped and the drill string is stationary the chemicals cannot contact the side of the casing against which the drill string rests. If, however, the drill string is rotated during pumping the rotary action carries the chemicals into contact with the casing wall and aids the cleaning operation.

Preferably, the tail pipe is connected to the cylindrical body in such a way as to permit relative movement thereof on a longitudinal axis but to prevent relative rotational movement thereof. Conveniently this may be achieved by providing a key on the tail pipe which is slidably within a longitudinally extending keyway in the cylindrical body, or vice versa.

Embodiments of the present invention will now be described, by way of example, with reference to the accompanying drawings, in which.

Figure 3:
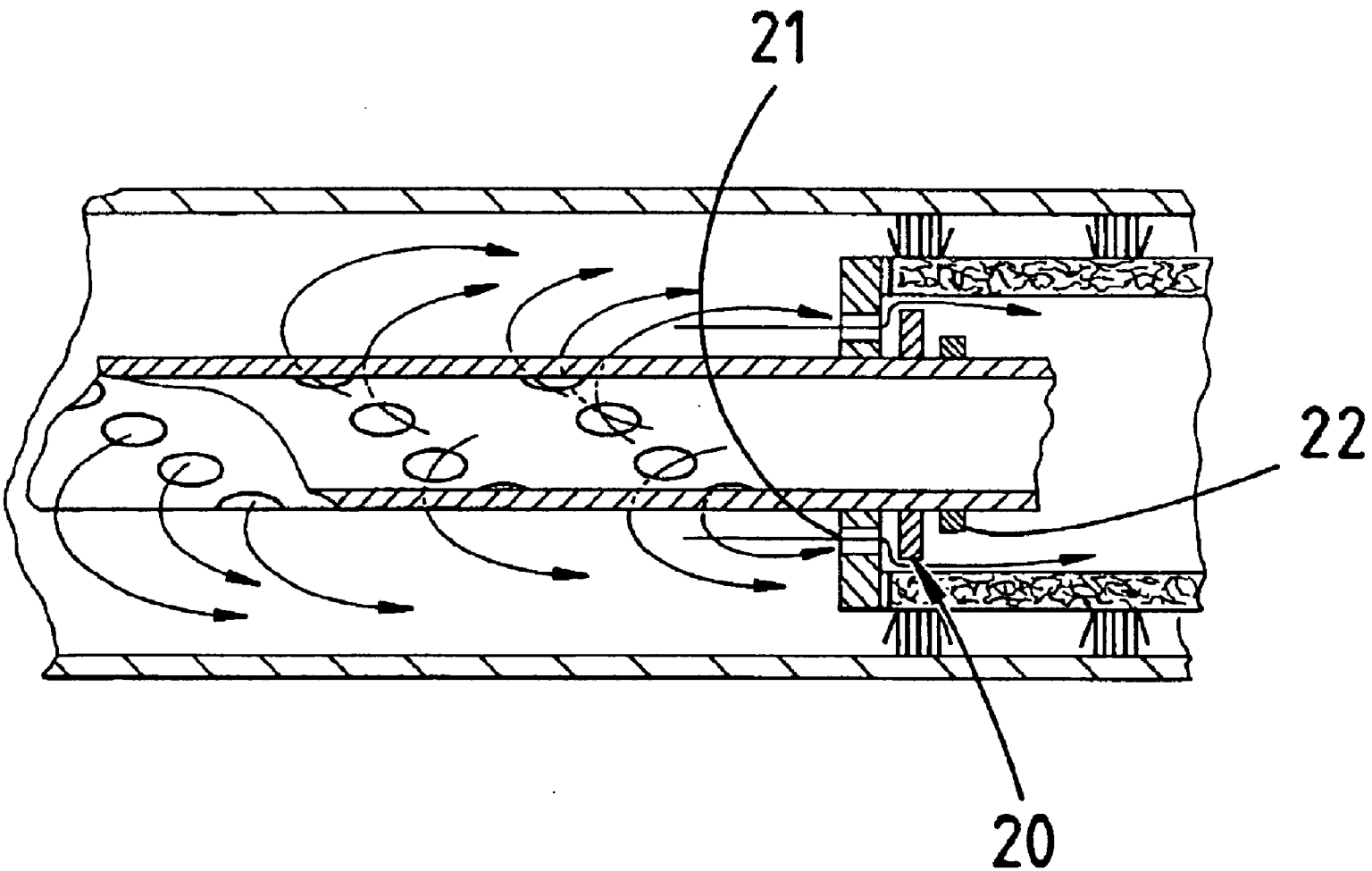
Figure 4:
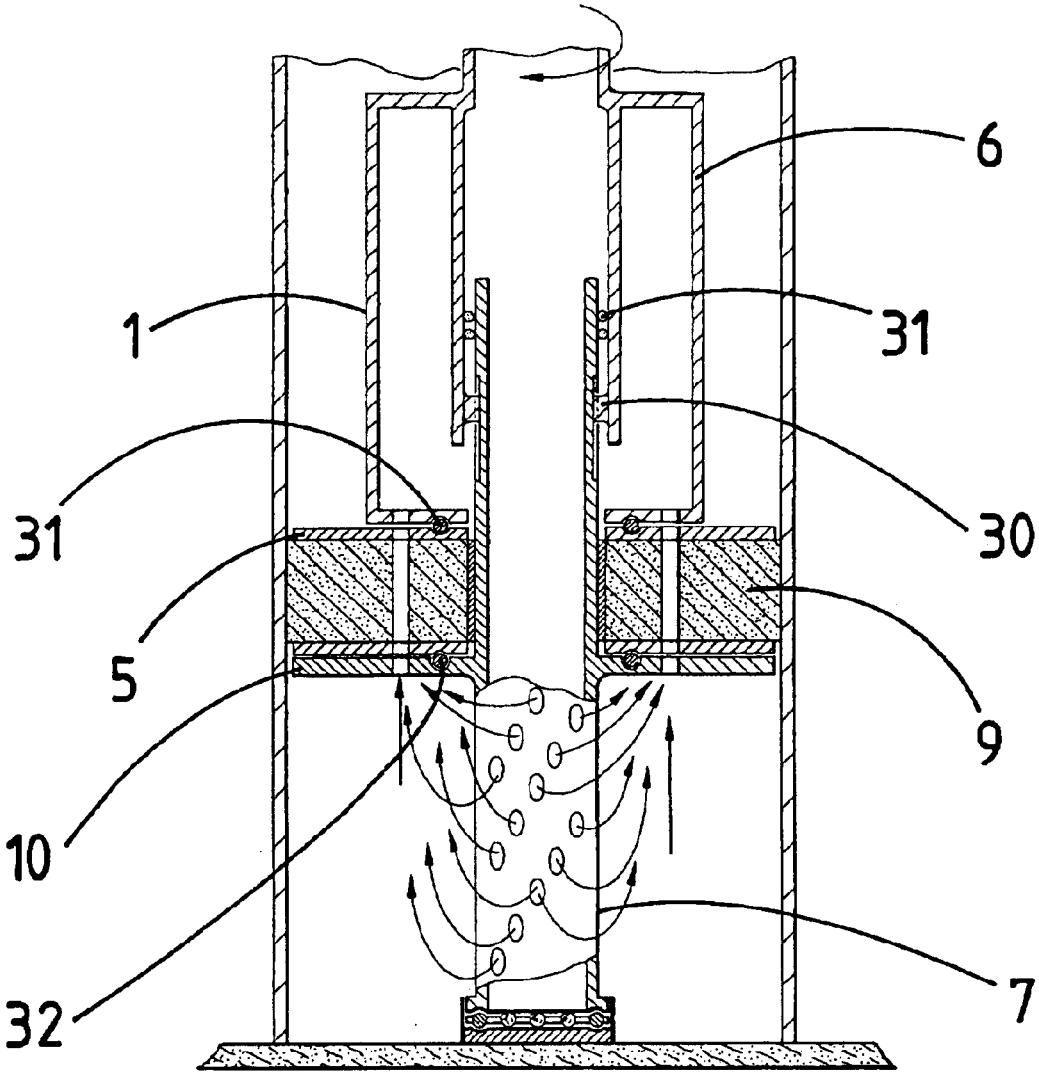

FIG. 3 shows details of a casing scraper according to the present invention comprising a pressure operated valve arrangement for isolating the filtration means and preventing debris collected thereon from washing back out; and FIG. 4 shows a partial vertical section in schematic form of a cleaning tool embodying the present invention in which the radially expandable rubber which serves to control the flow of cleaning fluid through the well casing is rotatable relative to the body of the casing scraper and to the drill string connected thereto.

Figure 1:
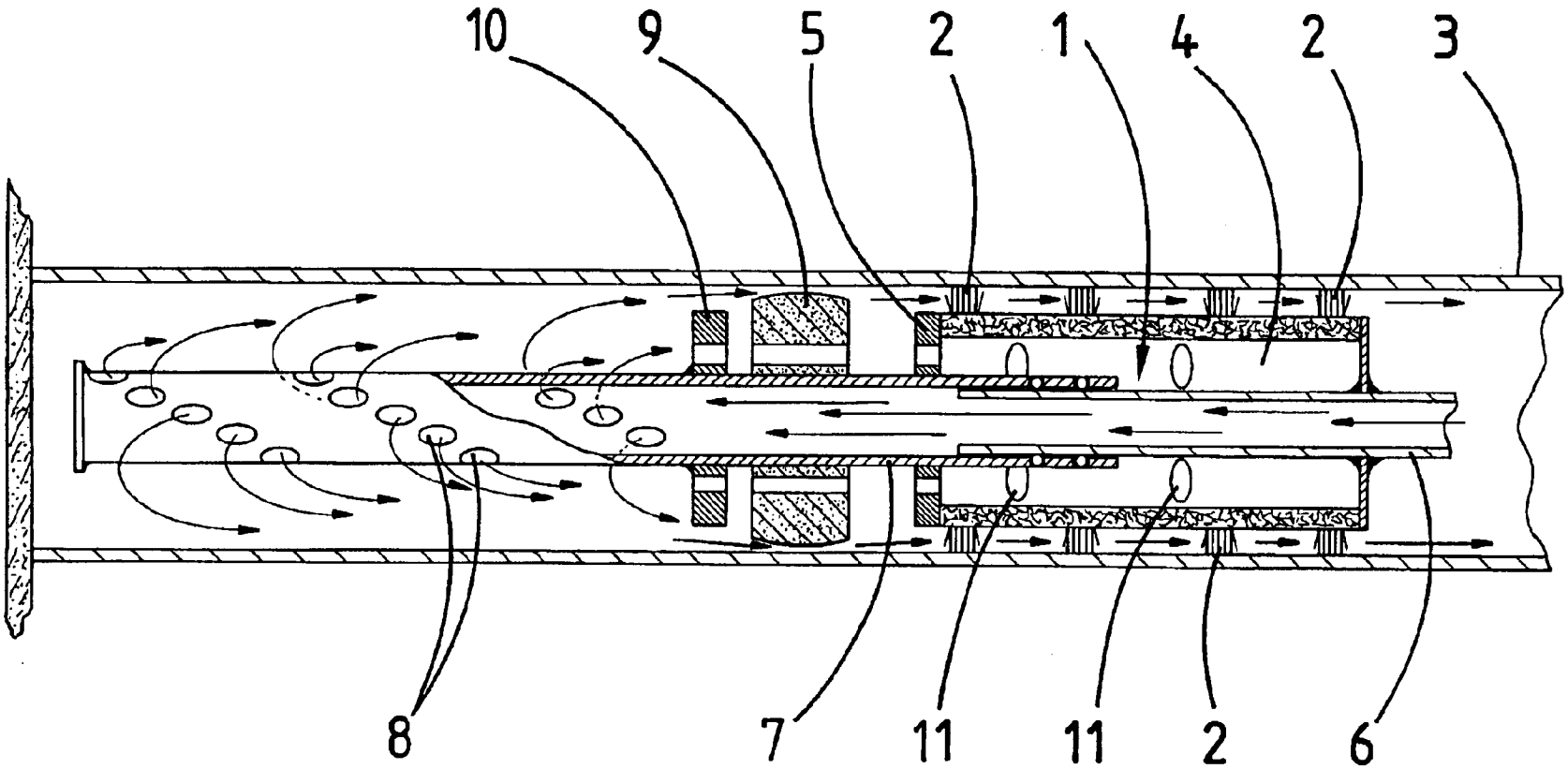
FIG. 1 shows a vertical section in schematic form of an oil well casing with a casing scraper in accordance with the present invention positioned therein and carrying out a cleaning operation thereon.

Referring to FIG. 1 of the drawings there is shown a casing scraper comprising a cylindrical body 1 having a plurality of groups 2 of wire bristles disposed in the outer surface thereof. The outer diameter of the casing scraper is defined by the wire bristles and is such that the ends of the wire bristles scrape the interior surface of a well casing 3. Although not shown in the drawing the cylindrical body 1 is adapted for connection to the end of a drill string. To this end the upper end of the cylindrical body may be provided with a threaded mandrel. The interior of the cylindrical body 1 defines a cavity within which is located a filter medium 4. The filter medium 4 may be loose or may be in the form of a removable cartridge. Access to the filter medium for the purposes of removal and inspection is through a removable plate 5 defining the transverse lower end face of the cylindrical body 1.

A pipe 6 extends through the transverse upper end face of the cylindrical body 1 and into the filter medium 4. The upper end of the pipe 6 which lies outside the cylindrical body 1 is adapted to be connected to a source of cleaning fluid at the surface of the well bore. The lower end of the pipe 6, which terminates within the cylindrical body 1, is connected by a sliding fit to a tail pipe 7. The tail pipe 7 extends through the removable plate 5 defining the transverse lower end face of the cylindrical body. Apertures 8 are provided in the lower end of the tail pipe 7 and it will be understood that cleaning fluid pumped from the well surface down the drill string will pass through the pipe 6, the tail pipe 7 and into the interior of the well casing below the cylindrical body 1 through the apertures 8.

Mounted on the tail pipe 7 immediately below the lowermost end of the cylindrical body 1 is a pack off rubber 9 and a pack off disc 10. The pack off rubber 9 forms a sliding fit on the tail pipe 7, but the pack off disc 10 is rigidly connected thereto. Apertures are provided in the disc 10, the rubber 9 and in the removable plate 5 which, under operating conditions to be described in greater detail hereinbelow, are aligned to define flow paths for the cleaning fluid pumped through the tail pipe 7 into the interior of the well casing back into the cavity defined by the cylindrical body 1 and through the filter medium 4. The cleaning fluid is then able to pass from the cavity in the cylindrical body through apertures 11 in the sidewalls of the cylindrical body 1.

In normal use the casing scraper is forced through a well casing on the drill string until the region of the well casing to be cleaned is reached. At this point cleaning fluid is pumped through the drill string and out into the interior of the well casing below the casing scraper itself. The cleaning fluid flows around the disc 10 and the rubber 9 and passes between the exterior of the cylindrical member 1 and the wall of the well casing towards the surface, removing with it debris and residues scraped from the wall of the well casing by the wire bristles 2. The casing scraper may also be rotated during the cleaning process by the drill string to facilitate a more thorough scouring of the casing wall. In this regard, operation of the casing scraper according to the present invention is essentially conventional.

Figure 2:
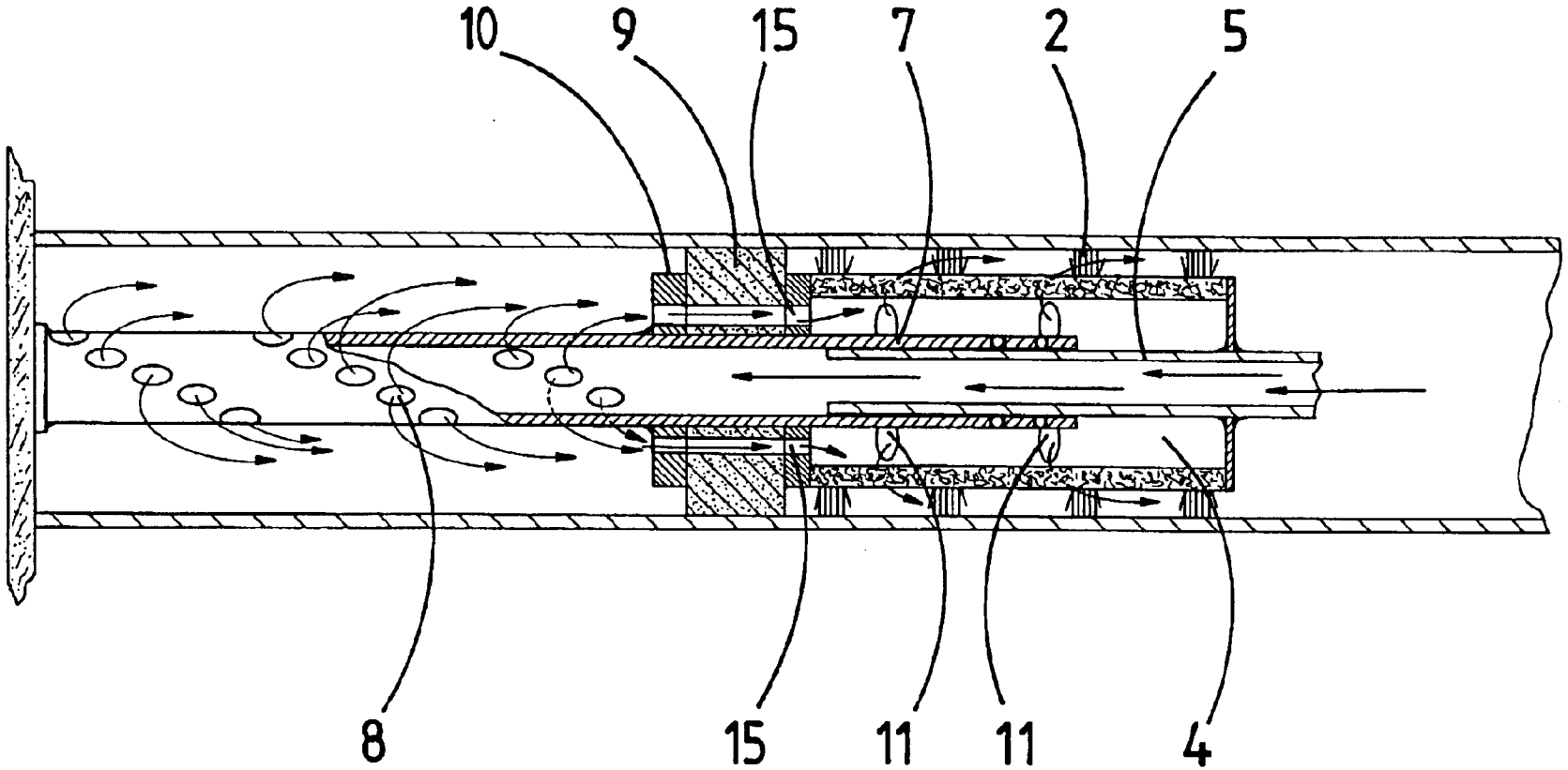
FIG. 2 shows the casing scraper of FIG. 1 after it has been switched to re-direct cleaning fluid returning to the surface from passing between the exterior of the cylindrical body and the interior wall of the well casing to passing through the filter located within the cylindrical body.

Referring now to FIG. 2 operation of the casing scraper according to the present invention to collect in the filter medium 4 residues and debris dislodged from the casing wall will be described. At any stage during the cleaning operation it may be required to collect residues and debris for subsequent inspection at the surface of the well bore. To achieve this the cylindrical member 1 is driven downwards on the drill string to cause relative longitudinal displacement of the tail pipe 7 relative to the pipe 5. As shown in FIG. 2, this is achieved by resting the lowermost end of the tail pipe 7 on the bottom of the well bore to brace it against the downward movement of the pipe 5. However, as an alterative to this the end of the tail pipe 7 may be engaged with the casing wall.

The relative displacement of the tail pipe 7 towards the cylindrical body 1 causes the rubber 9 to be compressed between the removable plate 5 and the fixed plate 10. This compression results in the rubber 9 expanding radially into tight engagement with the casing wall, thus isolating the region of the well casing below the casing scraper from the region above it. Now as cleaning fluid is pumped down the drill string and into the well casing through the apertures 8 in the tail pipe 7 the return flow has to pass through the flow paths 15 defined by the aligned apertures in the fixed plate 10, the rubber 9 and the removable plate 5, through the filter medium 4 within the cylindrical body 1 and out through the apertures 11 in the side walls of the cylindrical body 1. Any debris and residues contained within the cleaning fluid become trapped in the filter medium which can be inspected when the casing scraper is subsequently removed from the well casing.

A further advantage of the present invention is that as the filter medium becomes increasingly clogged with debris and residues the pressure required to pump cleaning fluid through it will increase. When the pressure reaches a predetermined level this may be interpreted by operatives on the surface as a signal that the cleaning operation is completed. As a precaution against the pressure in the drill string rising to an unacceptable level due, in particular, to the filtration means 4 becoming blocked up, pressure relief devices may be provided in the path of the cleaning fluid.

In the embodiment of the present invention described hereinbefore the rubber 9 is shown as being compressed between the removable plate 5 and the fixed plate 10 as a result of the tail pipe being braced against the bottom of the well casing or against the side thereof. It will be appreciated that alternative methods and techniques may be employed for switching the fluid flow path from around the exterior of the casing scraper to through the filter medium contained therein. For example, the tail pipe and the pipe may be joined by screw threaded sections, such that rotation of the drill string causes one to be screwed onto the other thereby reducing the distance between the plates and causing compression of the rubber. Alternatively, a flexible cup may be provided to the rear of the fixed plate which cup is caused to expand radially outwards into engagement with the casing wall under the effect of hydraulic pressure. This then provides a brace for the relative longitudinal movement of the pipe to the tail pipe and compression of the rubber.

Referring now to FIG. 3 there is shown a detail of the interior of a casing scraper according to the present invention and more specifically of a valve arrangement for isolating the filtration medium 4 contained within the cavity of the cylindrical body 1 when cleaning fluid is not being pumped therethrough. The valve arrangement serves to prevent debris and residue collected in the filtration means from being washed back out. The valve arrangement comprises a disc 20 which is mounted on the tail pipe 7 to cover the holes 21 in the removable plate 5 which form the flow paths into the filtration means 4. The disc 20 is slidable up and down on the tail pipe 7 between the removable plate 5 and a retaining lip 22 on the tail pipe. During pumping with the pack off rubber in place to direct fluid through the filtration means 4 the disc 20 rises to allow fluid to enter. As soon as pumping ceases the disc drops pack down to cover the holes 21.

It will further be understood that the filter medium may be housed separately from the cylindrical body which carries the scraper elements.

Referring to FIG. 4 of the drawings there is shown a further embodiment of a casing scraper according to the present invention. The casing scraper shown in FIG. 4 differs from that shown in FIGS. 1 and 2 in the following aspects. Firstly, the tail pipe 7 is keyed to the pipe 6 extending through the cylindrical body 1 and connecting to the drill string. The key 30 connecting the pipes 6 and 7 allows the tail pipe 7 to move longitudinally relative to the pipe 6 on bearings 31 to reduce the effective distance between the plates 5 and 10 and thereby compress the rubber plug 9 situated therebetween. It also serves to transmit rotational movement of the cylindrical body 1, effected through the drill string to the tail pipe. Secondly, the rubber plug 9 is rotatably mounted on the tail pipe 7, as are the plates 5 and 10 which serve to compress it. To facilitate rotation of the discs 5 and 10, thrust bearings 31 and 32 respectively are provided between the plate 5 and the cylindrical body 1 and between the plate 10 and the tail pipe 7. This arrangement allows the tailpipe 7 to rotate with the cylindrical body whilst still maintaining an upward compressive force on the rubber plug 9 to keep it set.

What is claimed is:

1. A casing scraper for cleaning the interior wall of a well casing, comprising a generally cylindrical body defining an uppermost end adapted for connection to a drill string and having a plurality of scraping or scouring elements disposed around the outer surface thereof for contacting the interior wall of the well casing and a bore extending through the cylindrical body, one end of which bore is adapted for connection to a source of cleaning fluid and the other end of which bore is connected to a tail pipe extending below the lowermost end of the cylindrical body, which tail pipe has at least one opening in it through which cleaning fluid may be circulated into the well casing, wherein the casing scraper further comprises filtration means located above the openings in the tail pipe and remotely operable means for selectively directing the flow of cleaning fluid from passing outside the filtration means to passing through the filtration means.

2. A casing scraper according to claim 1, wherein the filtration means is housed within the cylindrical body and forms an anmulus around the bore extending therethrough.

3. A casing scraper according to claim 2, wherein the means for selectively directing cleaning fluid to pass through the filtration means comprises a radially expandable element which is engageable with the casing wall to prevent fluid flow around the periphery thereof, which element has flow apertures therein through which cleaning fluid can pass into the filtration means.

4. A casing scraper according to claim 1, wherein the filtration means is housed separately from the cylindrical body, for example, on the tail pipe beneath the cylindrical body.

5. A casing scraper according to claim 4, wherein the means for selectively directing cleaning fluid to pass through the filtration means comprises a radially expandable element which is engageable with the casing wall to prevent fluid flow around the periphery thereof, which element has flow apertures therein through which cleaning fluid can pass into the filtration means.

6. A casing scraper according to claim 1, wherein the means for selectively directing cleaning fluid to pass through the filtration means comprises a radially expandable element which is engageable with the casing wall to prevent fluid flow around the periphery thereof, which element has flow apertures therein through which cleaning fluid can pass into the filtration means.

7. A casing scraper according to claim 6, wherein the said element comprises a rubber plug.

8. A casing scraper according to claim 7, wherein the element is annular and mounted on the said tail pipe, above the opening therein.

9. A casing scraper according to claim 7, wherein radial expansion of the element is achieved by compressing it between two plates which are operatively moveable relative to one another to reduce the distance therebetween.

10. A casing scraper according to claim 7, wherein the element is rotatable relative to the tail pipe.

11. A casing scraper according to claim 6, wherein the element is annular and is mounted on the said tail pipe, above the openings therein.

12. A casing scraper according to claim 11, wherein radial expansion of the element is achieved by compressing it between two plates which are operatively moveable relative to one another to reduce the distance therebetween.

13. A casing scraper according to claim 11, wherein the element is rotatable relative to the tail pipe.

14. A casing scraper according to claim 6, wherein radial expansion of the element is achieved by compressing it between two plates which are operatively moveable relative to one another to reduce the distance therebetween.

15. A casing scraper according to claim 14, wherein one of the said plates is mounted on the lower end of the cylindrical body and the other is mounted on the said tail pipe, and the tail pipe is able to move longitudinally within the bore extending through the cylindrical body to shorten the distance between the plates.

16. A casing scraper according to claim 6, wherein the element is rotatable relative to the tail pipe.

17. A casing scraper according to claim 16, wherein bearing are provided between the element and the tail pipe.

18. A casing scraper according to claim 17, wherein the tail pipe is connected to the cylindrical body in such a way as to permit relative movement thereof on a longitudinal axis but to prevent relative rotational movement thereof.

19. A casing scraper according to claim 18, wherein a key is provided on the tail pipe which is slidably within a longitudinally extending keyway in the cylindrical body, or vice versa.

20. A casing scraper according to claim 17, wherein the tail pipe is connected to the cylindrical body in such a way as to permit relative movement thereof on a longitudinal axis but to prevent relative rotational movement thereof.

* * * * *